US007063550B1

(12) United States Patent
Chen et al.

(10) Patent No.: US 7,063,550 B1
(45) Date of Patent: Jun. 20, 2006

(54) WATERPROOF STRUCTURE APPLIED TO AC PLUG AND SOCKET

(75) Inventors: Chang-Nan Chen, Shinjuang (TW); Teng-Sheng Hung, Shinjuang (TW); Huai-Hsiang Lu, Shinjuang (TW)

(73) Assignee: Liang Tei Co., Ltd., Taipei Hsien (TW)

( * ) Notice: Subject to any disclaimer, the term of this patent is extended or adjusted under 35 U.S.C. 154(b) by 0 days.

(21) Appl. No.: 11/034,013

(22) Filed: Jan. 13, 2005

(51) Int. Cl.
*H01R 13/62* (2006.01)

(52) U.S. Cl. ..... 439/320; 439/312

(58) Field of Classification Search ..... 439/320, 439/312, 296, 314, 321
See application file for complete search history.

(56) References Cited

U.S. PATENT DOCUMENTS 3,323,096 A * 5/1967 Appleton ..... 439/320
3,840,839 A * 10/1974 Smaczny et al. ..... 439/294
3,850,495 A * 11/1974 Glover ..... 439/273
6,468,100 B1 * 10/2002 Meyer et al. ..... 439/320
6,595,791 B1 * 7/2003 Below et al. ..... 439/271

FOREIGN PATENT DOCUMENTS

TW 562282 11/2003

* cited by examiner

*Primary Examiner*—Michael C. Zarroli

(57) ABSTRACT

A waterproof structure applied to an alternating current plug and an alternating current socket includes a plug body and a socket body. The plug body has an inserting portion, a covering portion formed thereon, a limiting portion formed between the plug body and the covering portion, and a washer positioned at one end of the limiting portion to be adjacent to the inserting portion. The socket body has an opening relative to the inserting portion for insertion, and a receiving portion formed thereon suitable for the covering portion to be engaged. The structure will not only be more stable than before to prevent separation occurred by an external force, but also be waterproof equally.

4 Claims, 4 Drawing Sheets

WATERPROOF STRUCTURE APPLIED TO AC PLUG AND SOCKET

BACKGROUND OF THE INVENTION

The present invention relates in general to a waterproof structure, and more particular, to a waterproof structure applied to an alternating current (AC) plug and an AC socket for improving plugging stability and waterproof effect.

Some zones are often invaded by heavy rain, like a typhoon, in the summer or the fall, specially the zones having island-type weather. The people of the zones suffering from the rain even have big finical damages. If the plugs and the sockets of electrical equipments are soaked, the electrical equipments will be out of order frequently. The people are even gotten an electric shock because of the leakage of electricity. For the reason, it will become an import issue to solve the above-mentioned problem.

A waterproof structure, applied to an alternating current plug and an alternating current socket has been disclosed for solving the problem. According to a Taiwan (R.O.C.) patent publication number 562282 titled 'Spiral Waterproof Structure Applied to A Wiring Plug and Socket', it has been disclosed that the structure comprises a clipper applied to a socket, and a sleeve which could be inserted therein by a wiring plug, wherein a wire extended from the rear of the sleeve, and a washer positioned covering the sleeve. Therefore, if the wiring plug within the sleeve inserted into the socket having the clipper, the wiring plug will be fastened to the socket automatically by means of the clipper. Then put a spiral cover from the rear of the sleeve in and fasten it to the clipper and the sleeve. The above-mentioned spiral cover has been used to prevent moisture into the structure. Finally, a nut engaged into the rear of the sleeve and fastened by the screw therein. The electric wire will be fixed and the purpose of waterproofing will be achieved therefor.

Although the above-mentioned structure can help the wiring plug and the socket both to be waterproof, the spiral cover has to be put on the rear of the sleeve and fastened to the clipper and the sleeve; and the nut is necessary for the structure to be engaged into the back of the sleeve to fasten the spiral cover together. For this reason, it is more complicated. Further, the structure needs much more elements applied to the plug and the socket. Hence, the plug and the socket become too complicated, too. That causes the structure is hardly used in an alternating current plug and socket in the lifetime.

BRIEF SUMMARY OF THE INVENTION

The present invention provides a waterproof structure can be applied to an alternating current plug and socket, wherein the structure is not only more stable than the prior art that the plug and socket are not easier to be separated because of external force, but is waterproof equally. The electrical equipment will not be damaged by the plug and socket soaked.

Accordingly, the waterproof structure of present invention includes a plug body and a socket body. The plug body has an inserting portion, a covering portion formed thereon, a limiting portion formed between the plug body and the covering portion, and a washer positioned at one end of the limiting portion to be adjacent to the inserting portion. The socket body has an opening relative to the inserting portion for insertion, and a receiving portion formed thereon suitable for the covering portion to be engaged. Moreover, a ring is positioned at one end of the receiving portion, a fixer is fixed to the receiving portion, and a washer is positioned between the fixer and the ring.

The objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
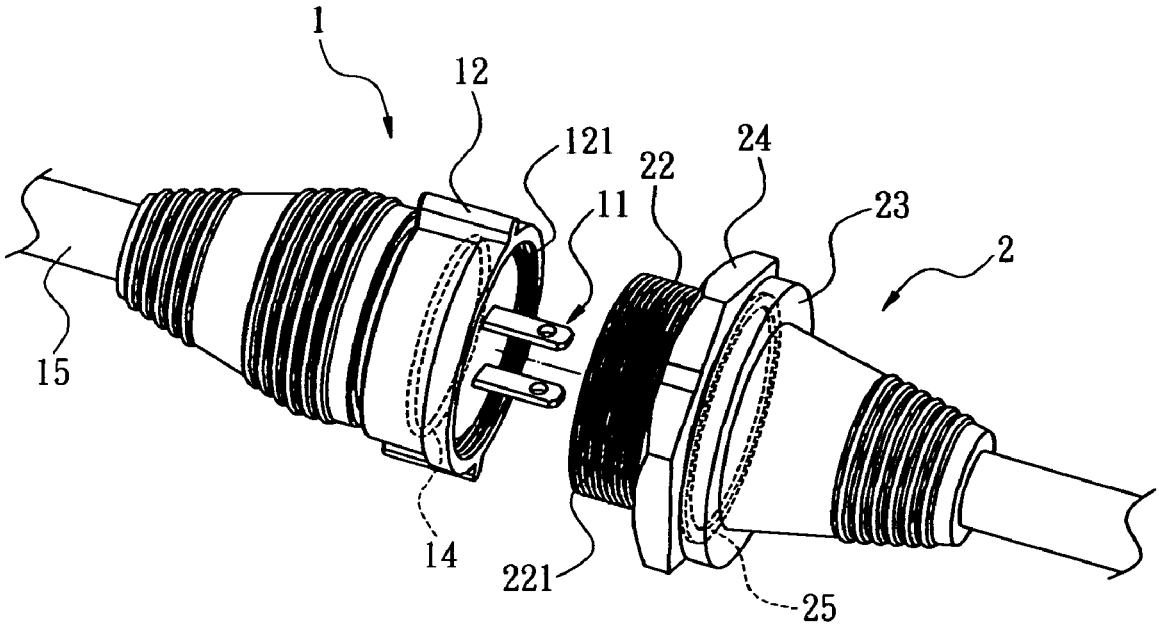
FIG. 1 is a three-dimensional schematic view as disclosed in the first embodiment of this invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
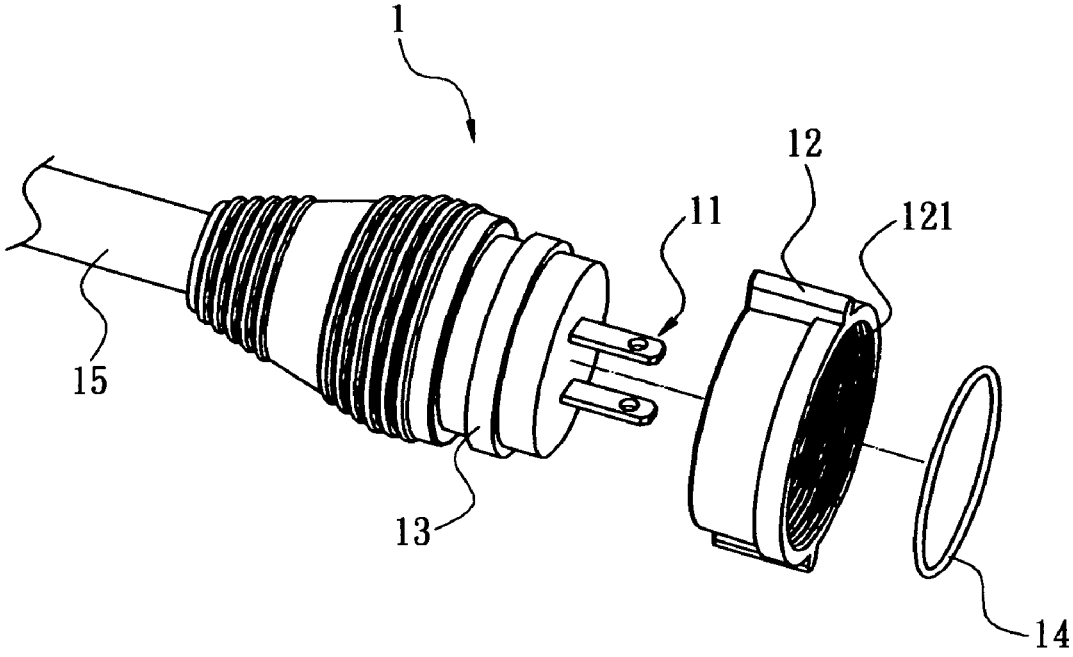
FIG. 2 is a three-dimensional schematic view, which shows the plug body as disclosed in the first embodiment of this invention.
Figure 3:
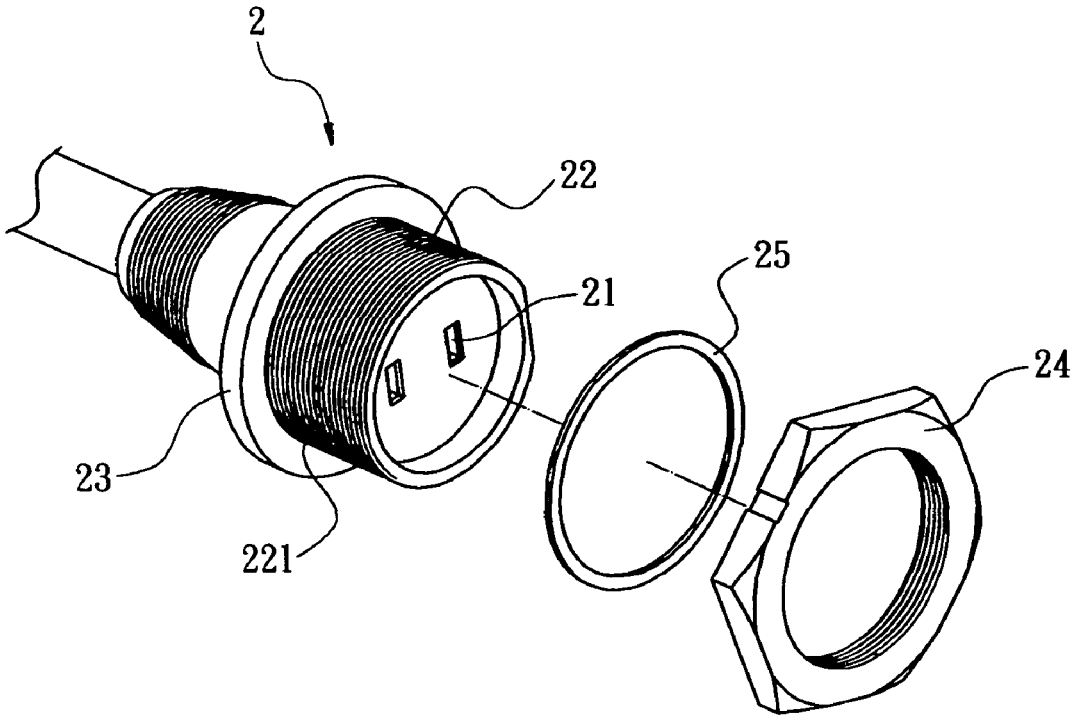
FIG. 3 is a three-dimensional schematic view, which shows the socket body as disclosed in the first embodiment of this invention.

Please refer to FIG. 1 to FIG. 3 at one time. This invention provides a waterproof structure applied to an alternating current plug and an alternating current socket both, wherein the structure can enable the plug body 1 plugged stably into the socket body 2. The plug body 1 and socket body 2 are not easier to be separated because of external force occurred, but are waterproof equally. The electrical equipment will not be damaged by the plug body 1 or the socket body 2 soaked therefor.

The plug body 1 is an alternating current plug according to FIG. 1, wherein comprises an inserting portion 11. The inserting portion 11 can be a twin-type contacting terminal, or a triple-type contacting terminal, or any kind of terminals such like what suitable for the European Specification or the United Stated of American Specification. The plug body 1 has a covering portion 12 positioned thereon, which the covering portion 12 has an inner thread 121 therein. Furthermore, there is a limiting portion 13 formed between the plug body 1 and the covering portion 12, hence, the covering portion 12 will be limited in a predetermined place. A washer 14 is positioned at one end of the limiting portion 13 and be adjacent to the inserting portion 11, wherein the cross-section of the washer 14 can be a circle, a rectangular, or any kind of shapes.

The socket body 2 according to FIG. 2 comprises at least an opening 21 suitable for the inserting portion 11 inserted into, a receiving portion 22 used for receiving the covering portion 12 engaged into, which the receiving portion 22 has a outer thread 221 thereon, a ring 23 positioned at one end of the receiving portion 22, a fixer 24 fixed to the receiving portion 22, and a washer 25 positioned between the fixer 24 and the ring 23, wherein the cross-section of the washer 25 can be a circle, or a rectangular, or any kind of shapes. The above-mentioned elements constitute the waterproof structure, which can be applied to an alternating current plug and an alternating current socket.

Figure 4:
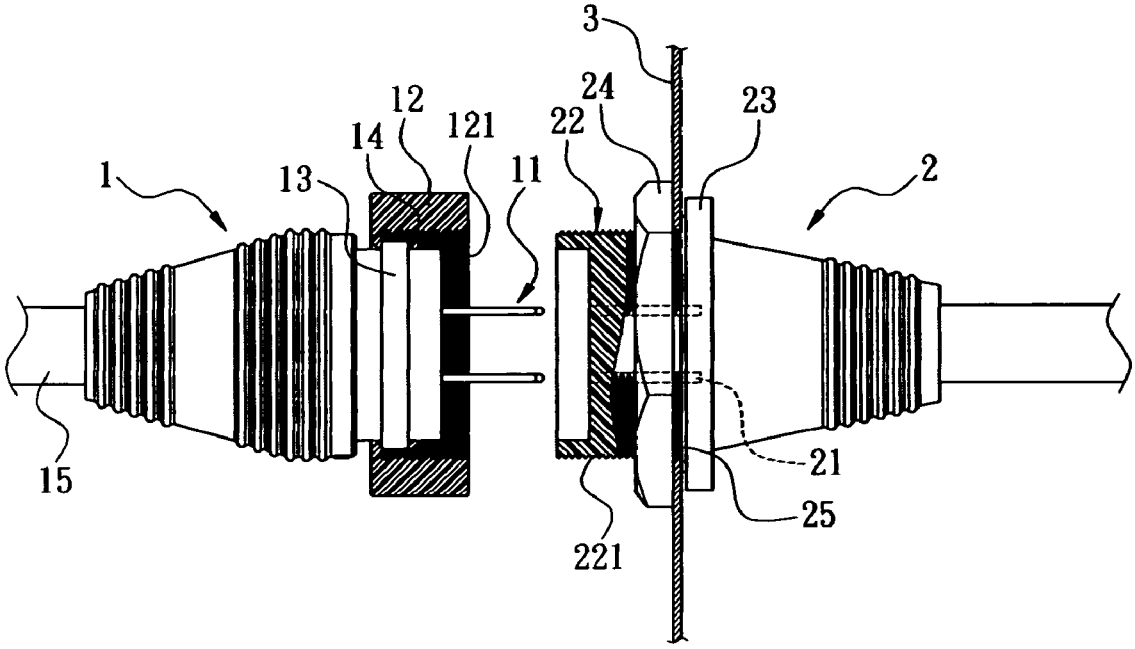
FIG. 4 is a schematic view, which shows a situation before the plug body plugged into the socket body as disclosed in the first embodiment of this invention.
Figure 5:
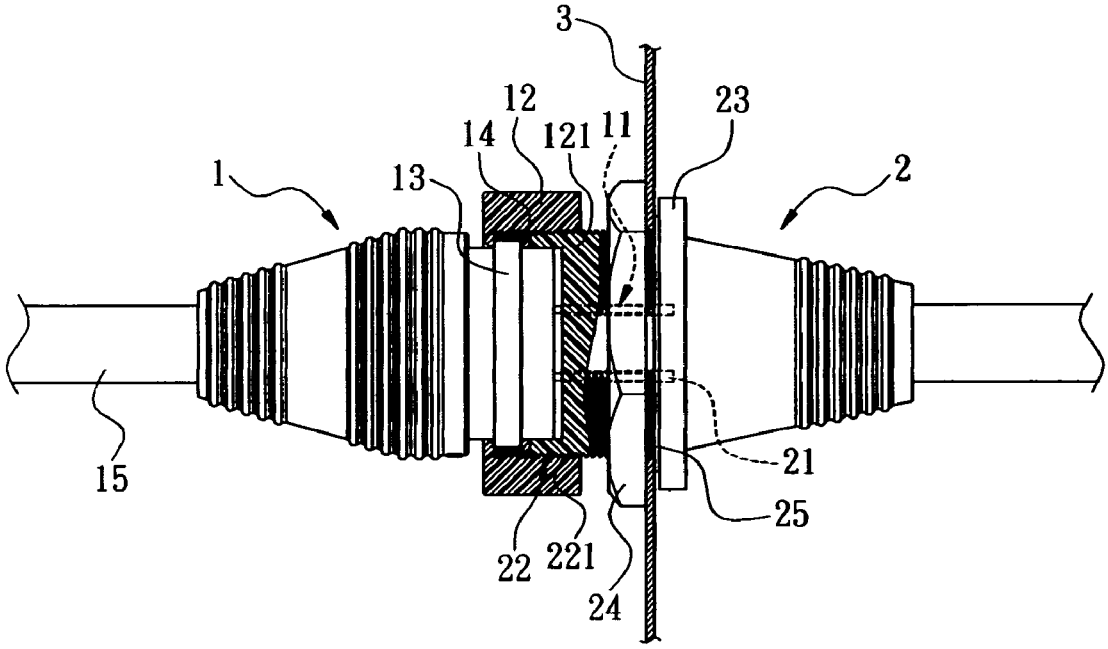
FIG. 5 is a schematic view, which shows another situation after the plug body plugged into the socket body as disclosed in the first embodiment of this invention.
Figure 6:
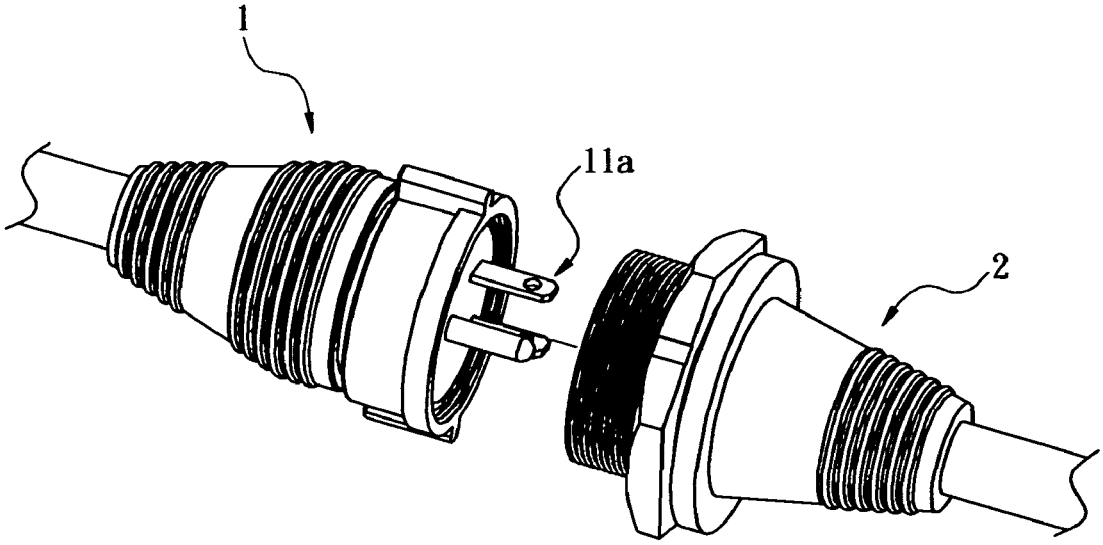
FIG. 6 is a three-dimensional schematic view as disclosed in the second embodiment of this invention.

Moreover, please refer to FIG. 4 and FIG. 5 together. For setting the socket body 2, one way is burying the rear of the socket body 2 under a wall; another way is putting the receiving portion 22 of the socket body 2 through a board 3 at first, and having a fixer 24 engaged onto the receiving portion 22. The ring 23 and the fixer 24 can fix the board 3 from its both sides. Therefore, the socket body 2 is fixed on the board 3. In the other hand, the plug body 1 is connected to electrical equipment by means of a wire (not shown). When the plug body 1 is plugged into the socket body 2, the inserting portion 11 of the plug body 1 will be inserted into the opening 21 of the socket body 2 relatively. The covering portion 12 is engaged onto the receiving portion 22, wherein the inner thread 121 of the covering portion 12 is designed to match the outer thread 221 of the receiving portion 22. The washer 14 is positioned between the plug body 1 and the socket body 2. Therefore, the plug body can be plugged into the socket body 2 stably so as to prevent separation by external force attacking. The structure is therefor waterproof as a result of the above. The electrical equipment will not be easier to be damaged because that the above-mentioned plug body 1 and the socket body 2 is not easier to submit moisture.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A waterproof structure applied to an alternating current (AC) plug comprising:

a plug body, one end of the plug body connecting to an electrical wire and the other end having an inserting portion and a covering portion, which has an inner thread, and the covering portion is located at a predetermined position that is adjacent to the inserting portion, a limiting portion formed between the plug body and the covering portion;

a socket body, one end connecting to an electrical wire, the other end having at least one opening which is suitable for the insertion of the inserting portion of the plug body, a receiving portion with outer thread, which can be tightly coupled with the inner thread of the covering portion when the plug body is connecting to the socket body, a ring at one edge of the receiving portion and a fixer; and a washer positioned between the fixer and the ring.

2. The waterproof structure of claim 1, wherein the cross-section of the washer is selected from a circle and a rectangular.

3. The waterproof structure of claim 1, wherein the cross-section of the washer is selected from a circle and a rectangular.

4. The waterproof structure of claim 1, wherein the inserting portion of the plug body is selected from the group, a twin-type contacting terminal and a triple-type contacting terminal.

* * * * *